US012758834B2

(12) United States Patent
Vanderzalm

(10) Patent No.: US 12,758,834 B2
(45) Date of Patent: Oct. 13, 2026

(54) GOLF TEE HOLDING DEVICE

(71) Applicant: Vanessa Rheanne Vanderzalm, West Vancouver (CA)

(72) Inventor: Vanessa Rheanne Vanderzalm, West Vancouver (CA)

( * ) Notice: Subject to any disclaimer, the term of this patent is extended or adjusted under 35 U.S.C. 154(b) by 0 days.

(21) Appl. No.: 19/285,816

(22) Filed: Jul. 30, 2025

(65) Prior Publication Data

US 2026/0034415 A1 Feb. 5, 2026

Related U.S. Application Data

(63) Continuation-in-part of application No. 29/970,123, filed on Oct. 25, 2024.

(60) Provisional application No. 63/678,513, filed on Aug. 1, 2024.

(51) Int. Cl.
*A63B 57/20* (2015.01)
*A63B 57/10* (2015.01)

(52) U.S. Cl.
CPC ..... *A63B 57/203* (2015.10); *A63B 57/10* (2015.10)

(58) Field of Classification Search
CPC ..... A63H 3/005; A63B 57/203; A63B 57/10; A63B 57/0032; A63B 2209/10
See application file for complete search history.

(56) References Cited

U.S. PATENT DOCUMENTS 3,298,579 A 1/1967 Smith
D243,069 S * 1/1977 Igelman ..... D9/428
4,950,196 A 8/1990 Fortune et al.
5,433,436 A 7/1995 Hoyt et al.
5,944,577 A * 8/1999 Yanofsky ..... A63H 3/005 446/73
6,095,934 A 8/2000 Ohama
11,547,911 B2 1/2023 Krauter
(Continued)

FOREIGN PATENT DOCUMENTS

KR 900008659 Y1 9/1990
KR 20180001959 A1 6/2018
(Continued)

OTHER PUBLICATIONS

Voodoo Golf Ball Tee Holder | Novelty Keychain Accessory for Bag | Gifts for Men | Fits 3 1/4, 2 3/4, 1 1/2 Tees, Black, Small, retrieved from the internet, retrieved on Jul. 25, 2025; <URL: https://www.amazon.in/Voodoo-Golf-Novelty-Keychain-Accessory/dp/B0BXTDT26M>.
(Continued)

*Primary Examiner* — Shawn M Braden

(57) ABSTRACT

A golf-tee holding device is intended to provide users with a weighed and easy to carry golf-tee holder. Further, the device can hold multiple golf tees in and upright and easily accessible fashion. Furthermore, the weighed golf-tee holder is shaped like an animal carrying a bag, and the bag has a plurality of tee-receiving holes that are arranged in a grid pattern. The animal can be shaped as an eagle, an alligator, a tiger, or any other kind of animal. Additionally, the device has an eyelet attached to the animal-shaped structure, for attaching any fastener of choice that helps users to hang the device on various surfaces. Thus, the golf-tee holding device is a user-friendly, fun, and aesthetically appealing golf-tee holding device.

19 Claims, 14 Drawing Sheets

(56) References Cited

U.S. PATENT DOCUMENTS

| | | | | |
|---|---|---|---|---|
| 2005/0032456 | A1* | 2/2005 | Armenise | A63H 3/005 446/268 |
| 2022/0249927 | A1* | 8/2022 | Jeoung | A63B 57/203 |
| 2024/0399221 | A1* | 12/2024 | Wadher | A63B 57/207 |

FOREIGN PATENT DOCUMENTS

| | | | | |
|---|---|---|---|---|
| WO | WO-0003778 | A1 * | 1/2000 | A63H 3/005 |
| WO | 2016125954 | A1 | 8/2016 | |

OTHER PUBLICATIONS

Voodoo Golf, retrieved from the internet, retrieved on Jul. 25, 2025; <URL: https://www.voodoogolfco.com/>.
Squishtees, retrieved from the internet, retrieved on Jul. 25, 2025; <URL: https://squishtees.com/>.

* cited by examiner

GOLF TEE HOLDING DEVICE

The current application claims a priority to the U.S. provisional patent application Ser. No. 63/678,513 filed on Aug. 1, 2024.

The current application is also a continuation-in-part (CIP) application of the U.S. design application Ser. No. 29/970,123 filed on Oct. 25, 2024.

FIELD OF THE INVENTION

The present invention generally relates to a golf-tee holding device. More specifically, the present invention is a golf-tee holder that is shaped like an animal carrying a bag, and the bag has a plurality of tee-receiving holes.

BACKGROUND OF THE INVENTION

Traditionally, a golf-tee holder is in a relatively similar weight range to the golf tees that are carried by the golf-tee holder. This leads to the golf-tee holder being easily lost as well as the golf tees. Moreover, a golf-tee holder typically does not arrange the golf tees in a manner that allows the golf tees to be readily accessible to a user.

An objective of the present invention is to provide a golfer with a convenient way to carry and access their golf tees during a game. To that end, the present invention comprises a weighted golf-tee holder that is shaped as a caricaturized figurine carrying a bag, and the bag has a plurality of tee-receiving holes that are arranged in a grid pattern. Further, the figurine can be shaped like an eagle, an alligator, a tiger, or any other kind of animal or non-animal structure that can provide aesthetic appeal to the device. Additionally, an eyelet is attached to the animal-shaped structure for attaching any fastener, that helps users to hang the device on user's actual golf bags, as well as various other surfaces.

SUMMARY OF THE INVENTION

The present invention is intended to provide users with a golf-tee holding device that is weighed and easy to carry. Further, the present invention can hold multiple golf tees in an upright and easily accessible fashion. Furthermore, the weighed golf-tee holder is shaped as a caricaturized figurine carrying a bag and the bag has a plurality of tee-receiving holes that are arranged in a grid pattern. The figurine may be shaped as an eagle, an alligator, a tiger, or any other kind of animal or non-animal structure, to provide weighted support and aesthetic appeal. Additionally, the present invention has an eyelet attached to the figurine for attaching any fastener, that helps users to hang the device on various surfaces including user's golf bags. Thus, the present invention is a user-friendly, fun, and aesthetically appealing golf-tee holding device.

DETAILED DESCRIPTION OF THE INVENTION

All illustrations of the drawings are for the purpose of describing selected versions of the present invention and are not intended to limit the scope of the present invention.

An objective of the present invention is to provide a golfer with a convenient way to carry and access their golf tees during a game. The present invention achieves its objective by incorporating a mini silicone golf bag with four small holes, each of which is designed to hold a golf tee.

Figure 6:
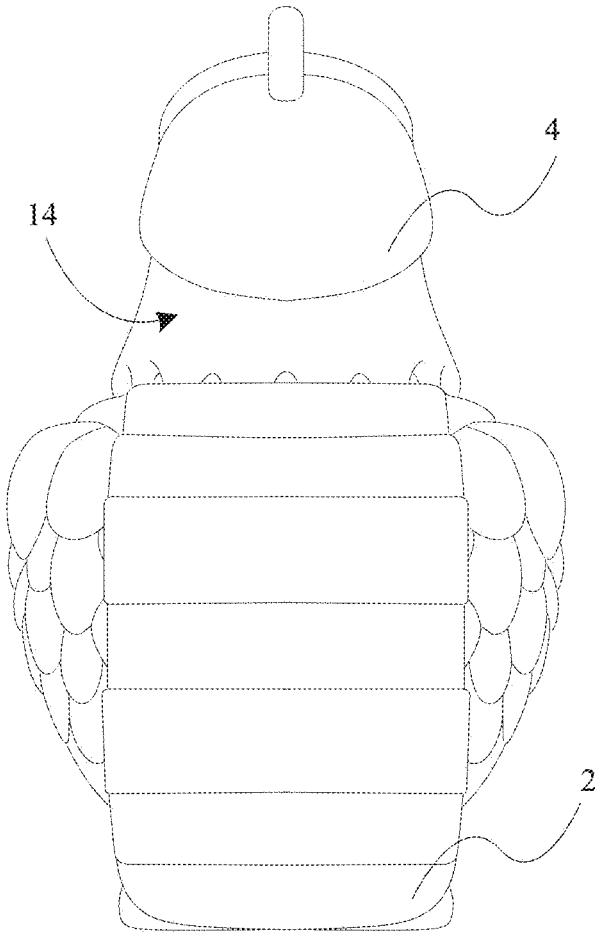
FIG. 6 is a rear elevational view of the present invention.
Figure 7:
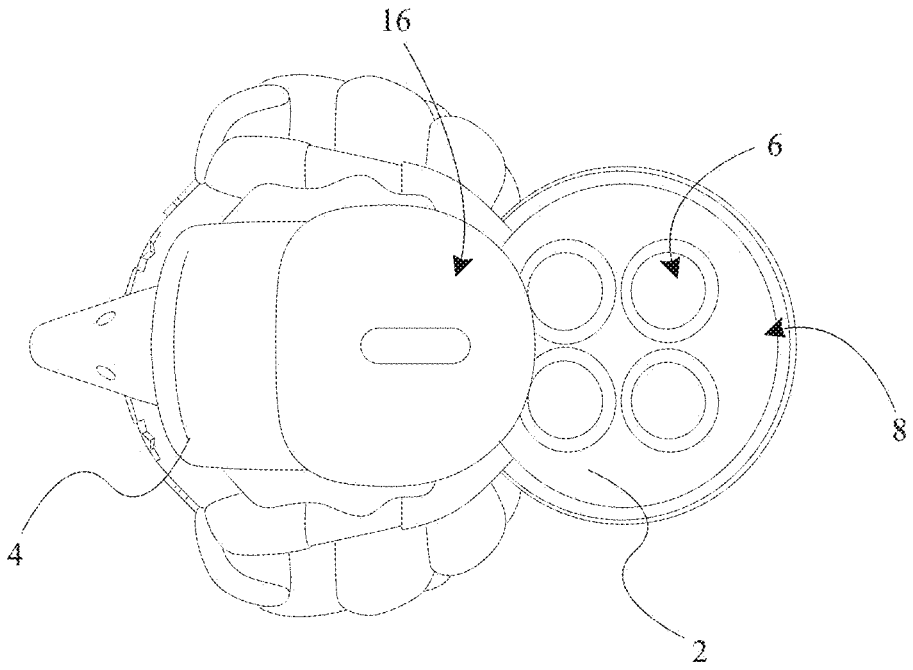
FIG. 7 is a top plan view of the present invention.
Figure 8:
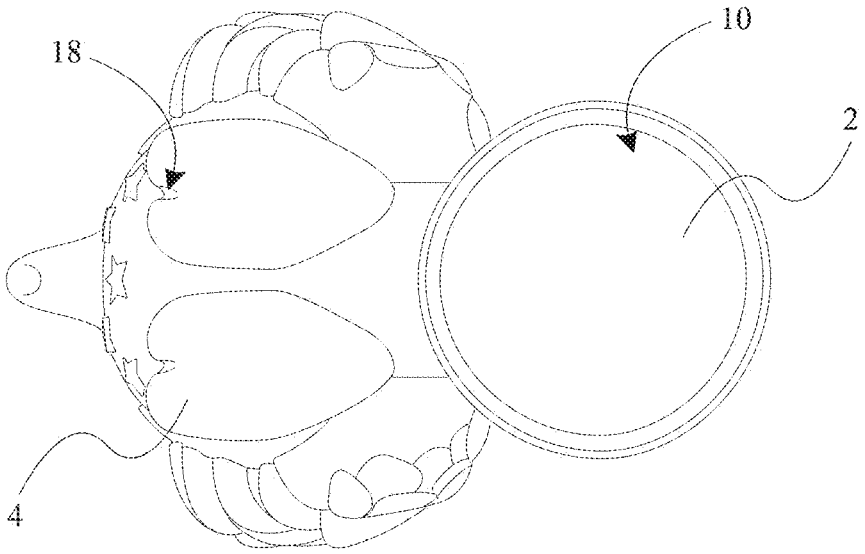
FIG. 8 is a bottom plan view of the present invention.
Figure 9:
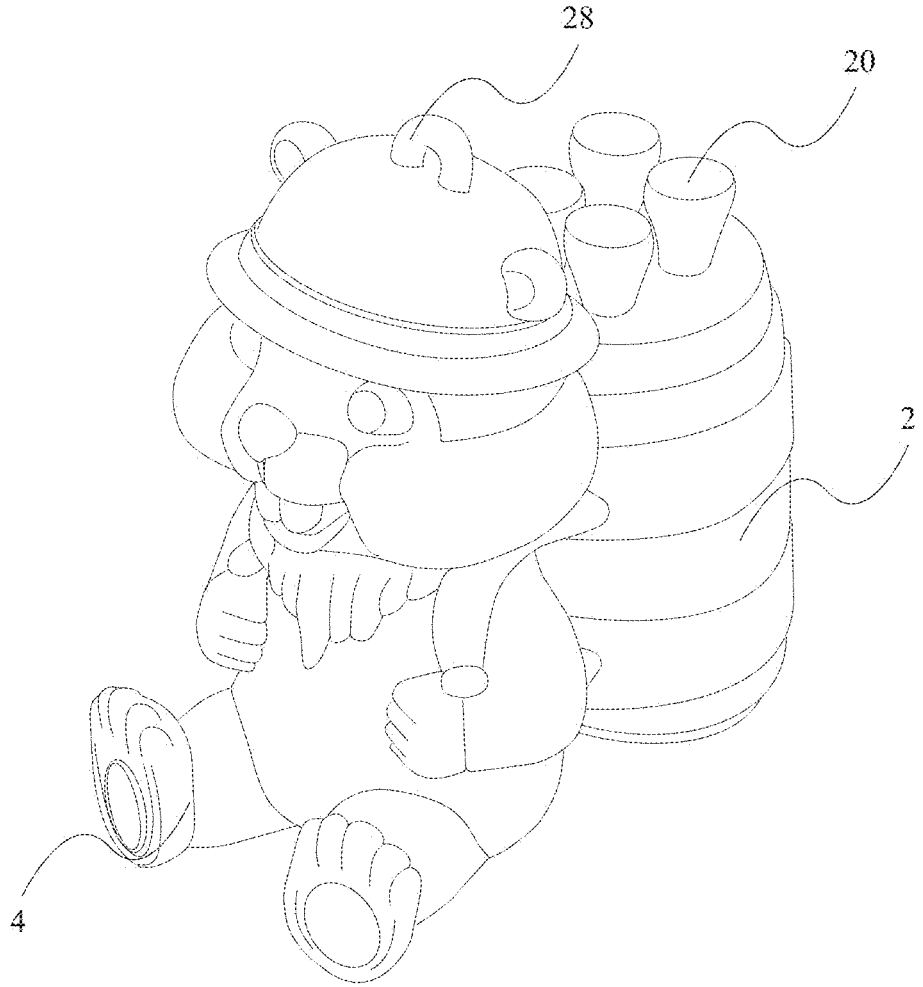
FIG. 9 is a top-front-left perspective view of the present invention, wherein the support figurine is in a caricaturized shape a gopher, and a plurality of golf tees are placed within the plurality of tee-receiving holes inside a golf-bag-shaped body.

The following description is in reference to FIG. 1 through FIG. 14. According to a preferred embodiment, the present invention comprises a golf-bag-shaped body 2, a support figurine 4, and a plurality of tee-receiving holes 6. The golf-bag-shaped body 2 is a miniaturized silicone golf bag that is configured to be the primary functional component with the plurality of tee-receiving holes 6 that are specifically placed to securely hold the golf tees. To that end, the golf-bag-shaped body 2 comprises a first body end 8 and a second body end 10, wherein the first body end 8 is positioned opposite to the second body end 10 about the golf-bag-shaped body 2. Preferably, the first body end 8 constitutes a top end of the golf-bag-shaped body 2, and the second body end 10 constitutes a bottom end of the golf-bag-shaped body 2. The plurality of tee-receiving holes 6 is preferably four small holes traversing into the back of the miniaturized golf-bag-shaped body to securely hold the golf tees. To that end, each of the plurality of tee-receiving holes 6 traverses from the first body end 8 into the golf-bag-shaped body 2. Further, as seen in FIG. 7, the plurality of tee-receiving holes 6 is distributed across the first body end 8, and the plurality of tee-receiving holes 6 is positioned parallel to each other. However, it should be noted that the plurality of tee-receiving holes 6 may comprise any other number as long as the intents of the present invention are not altered.

Figure 1:
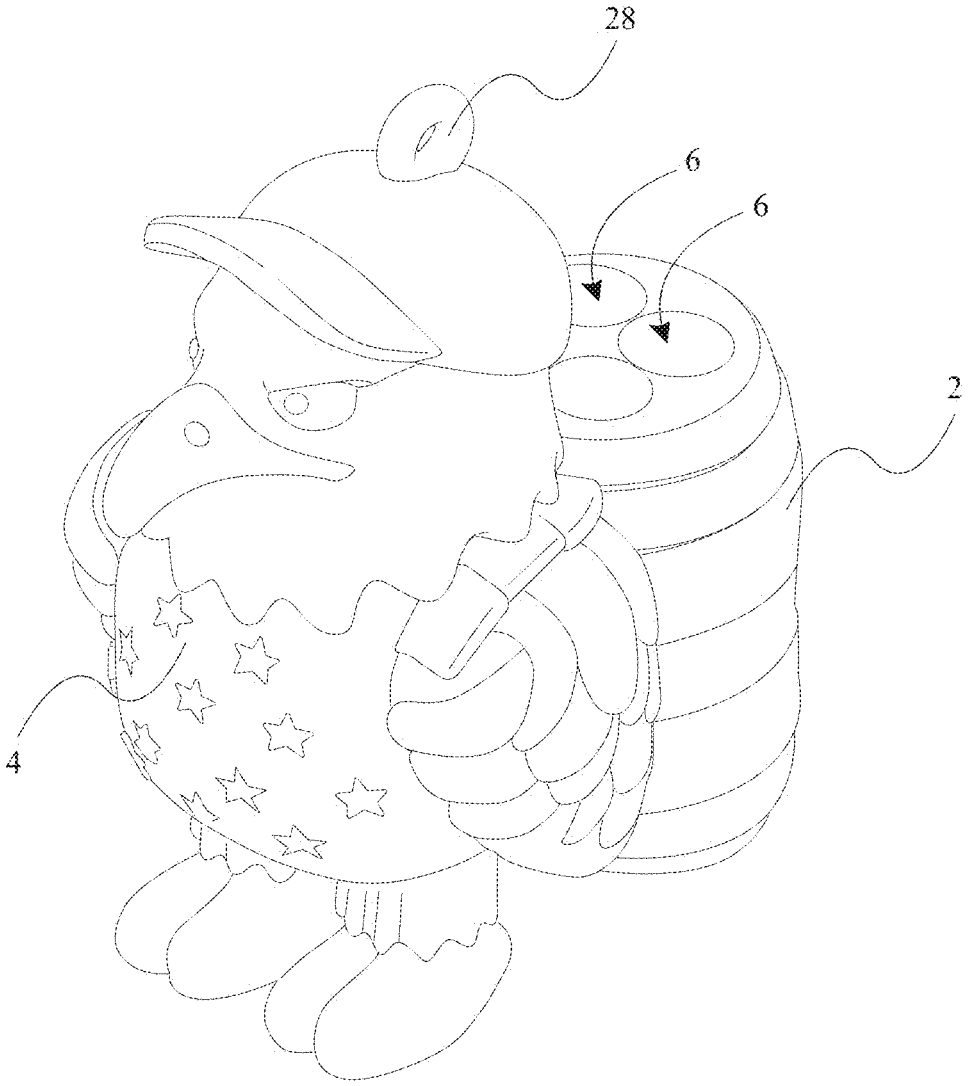
FIG. 1 is a top-front-left perspective view of golf-tee holding device, wherein the support figurine is in a caricaturized shape of an eagle, and wherein a plurality of golf-tee-receiving holes are empty.
Figure 2:
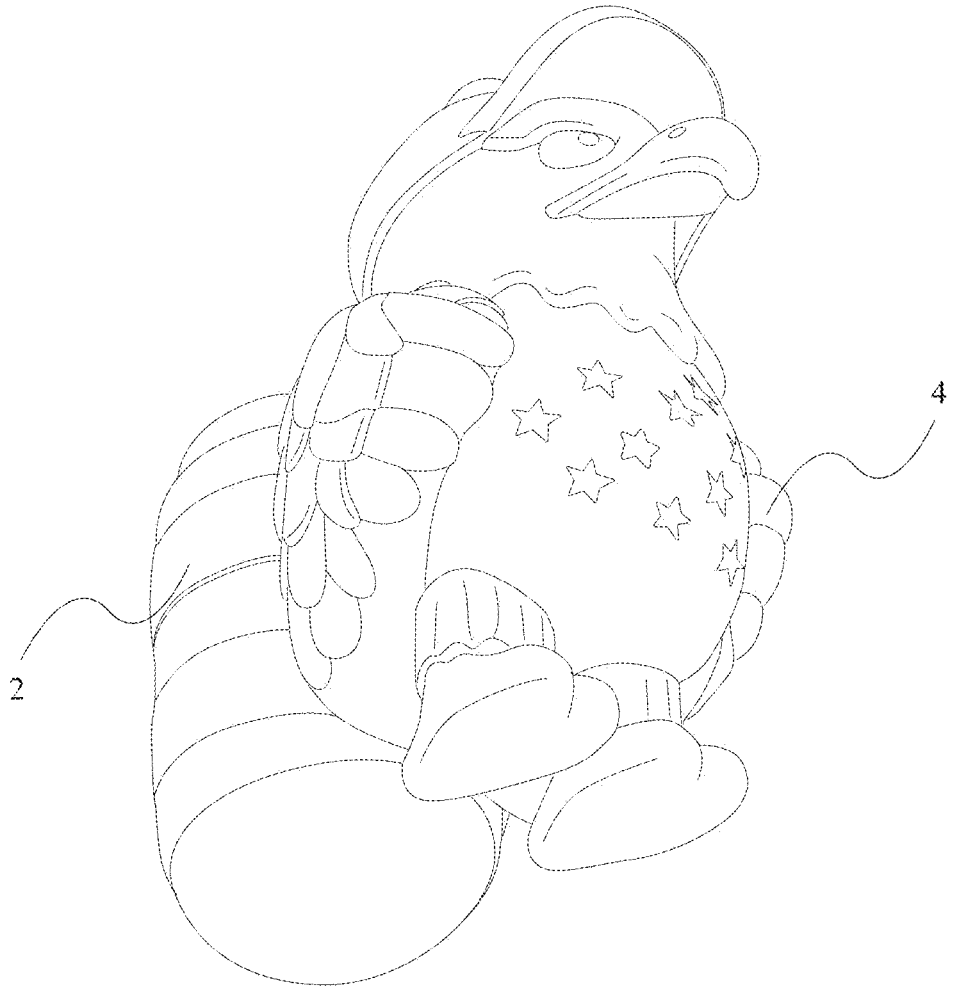
FIG. 2 is a bottom-rear-right perspective view of the present invention.
Figure 3:
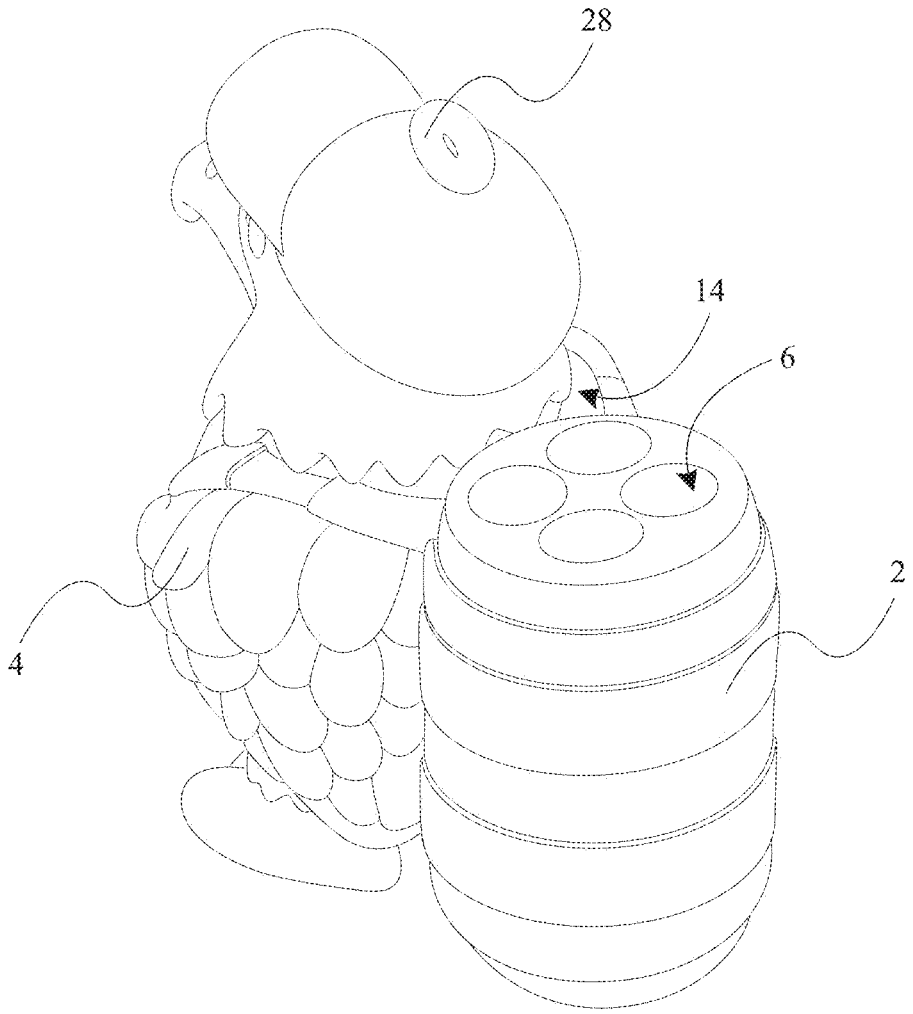
FIG. 3 is a top-rear-left perspective view of the present invention.
Figure 4:
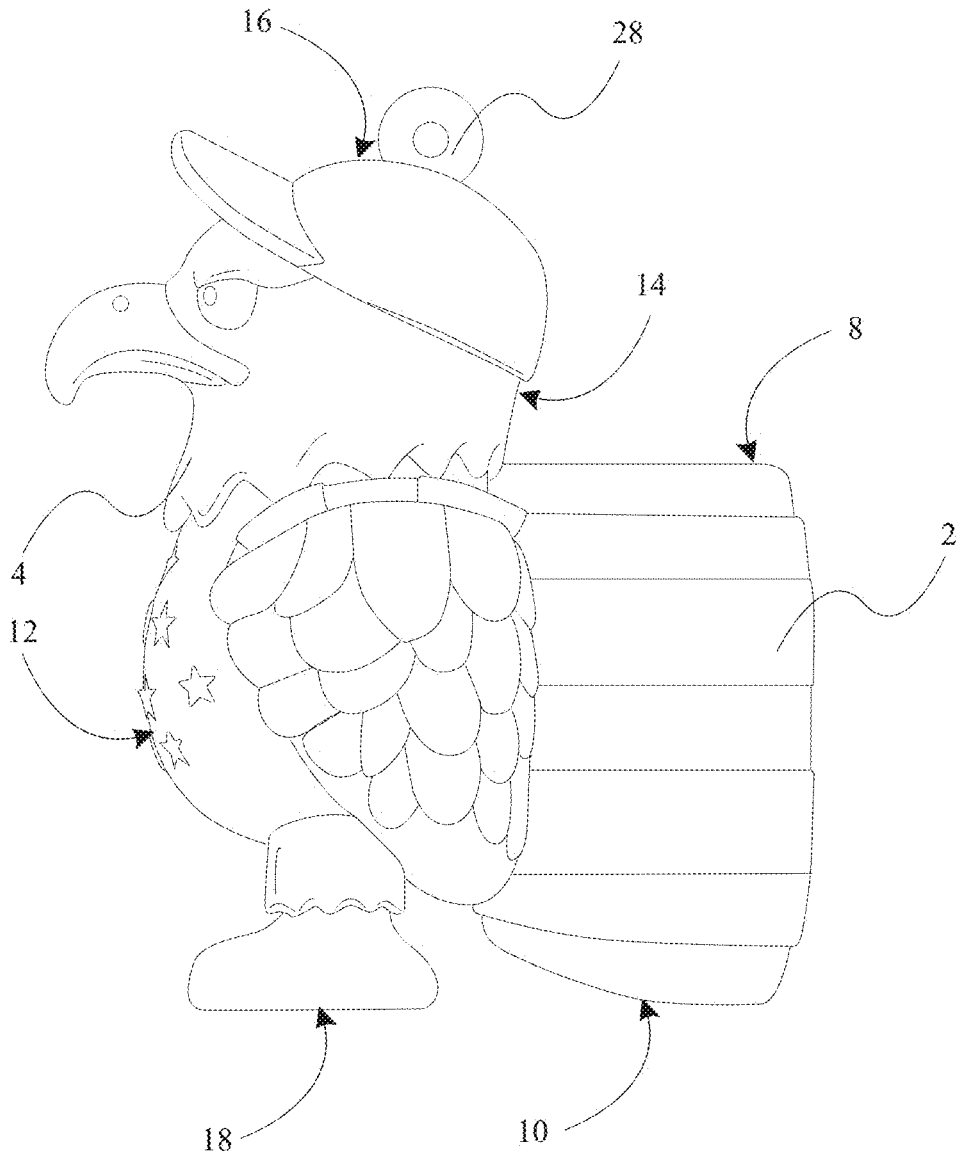
FIG. 4 is left-side elevational view of the present invention.
Figure 5:
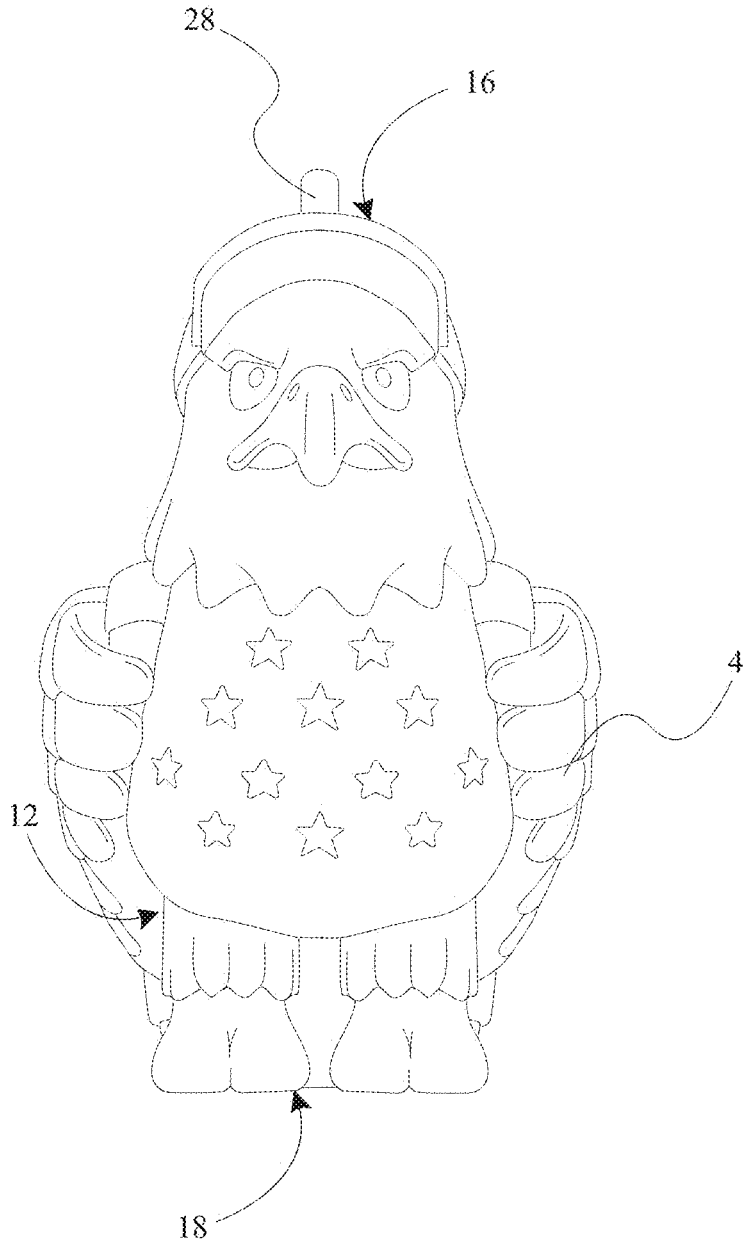
FIG. 5 is front elevational view of the present invention.

The support figurine 4 provides the present invention with most of its weight and is a decorative component that adds an aesthetic appeal to the overall look (i.e., secondary to the function of the golf-bag-shaped body). The support figurine 4 comprises a first lateral surface 12, a second lateral surface 14, a first figurine end 16, and a second figurine end 18. As seen in FIG. 4 through FIG. 6, the first lateral surface 12 constitutes a front surface of the support figurine 4, and the second lateral surface 14 constitutes a rear surface of the support figurine 4. In other words, the first lateral surface 12 is positioned opposite to the second lateral surface 14 about the support figurine 4. Similarly, the first figurine end 16 constitutes a top end of the support figurine 4, and the second figurine end 18 constitutes a bottom end of the support figurine 4. In other words, the first figurine end 16 is positioned opposite to the second figurine end 18 about the support figurine 4. Further, the first lateral surface 12 and the second lateral surface 14 are positioned in between the first figurine end 16 and the second figurine end 18. As seen in FIG. 1 through FIG. 4, FIG. 9, FIG. 11 through FIG. 14, the golf-bag-shaped body 2 is connected adjacent to the second lateral surface 14. Furthermore, as seen in FIG. 1 through FIG. 14, the support figurine 4 is a caricature animal. The shape and size of the caricaturized animal helps provide enough weight to balance the weight of the tees as well as provides aesthetic appeal to the device. In reference to FIG. 1 through FIG. 8, the caricature animal is a patriotically-decorated bald eagle. However, it should be noted that the caricature animal may comprise any other animal, bird, or character (including but not limited to humans, aliens, etc.) with any other shape, components, and arrangement of components that are known to one of ordinary skill in the art as long as the intents of the present invention are not hindered.

According to the preferred embodiment, the golf-bag-shaped body 2 and the support figurine 4 are made of silicone. The silicone material securely grips the golf tees, thus preventing the golf tees from falling out while also allowing easy access. This configuration of the present invention ensures that a golfer can quickly retrieve and replace their golf tees as needed.

It is an objective of the present invention to hold and easily access golf tees. Accordingly, the present invention may further comprise a plurality of golf tees 20, wherein each of the plurality of golf tees 20 is positioned into a corresponding tee-receiving hole from the plurality of tee-receiving holes 6. The plurality of golf tees 20 are small pegs used to elevate a golf ball off the ground for the initial stroke (the "tee shot") of each hole. While optional, using a tee provides a significant advantage for powerful drives by ensuring a consistent setup and potentially increasing distance. The plurality of golf tees 20 may be made of any material and may be any size and color that are known to one of ordinary skill in the art, as long the intents of the present invention are not altered.

Figure 10:
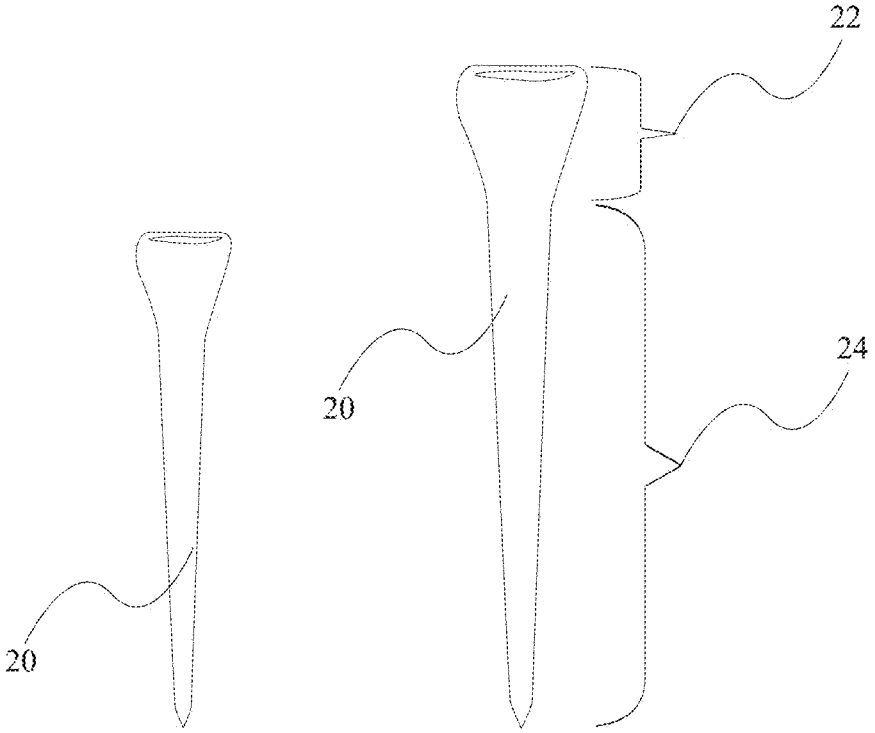
FIG. 10 is a front elevational view of a plurality of golf tees of different sizes.

As seen in FIG. 10, each of the plurality of golf tees 20 may comprise a golf-tee head 22 and a golf-tee shaft 24. Preferably, the golf-tee head 22 is a top end of the golf tee that is protruding outside of the tee-receiving hole and the golf-tee shaft 24 is the body of the golf tee that tapers down from the golf-tee head 22. Accordingly, in the preferred embodiment, the golf-tee shaft 24 is positioned within the corresponding tee-receiving hole and the golf-tee head 22 is positioned externally to the corresponding hole, adjacent to the first body end 8.

It is an objective of the present invention to hold the plurality of golf tees 20 in a secure and snug manner within the golf-bag-shaped body 2 without tipping over. To accomplish this, the support figurine 4 and the golf-bag-shaped body 2 are weighed accordingly with the help of the material used. In other words, a combined center of gravity between the support figurine 4 and the golf-bag-shaped body 2 is configured to hold the plurality of golf tees 20 in an upright orientation.

Figure 11:
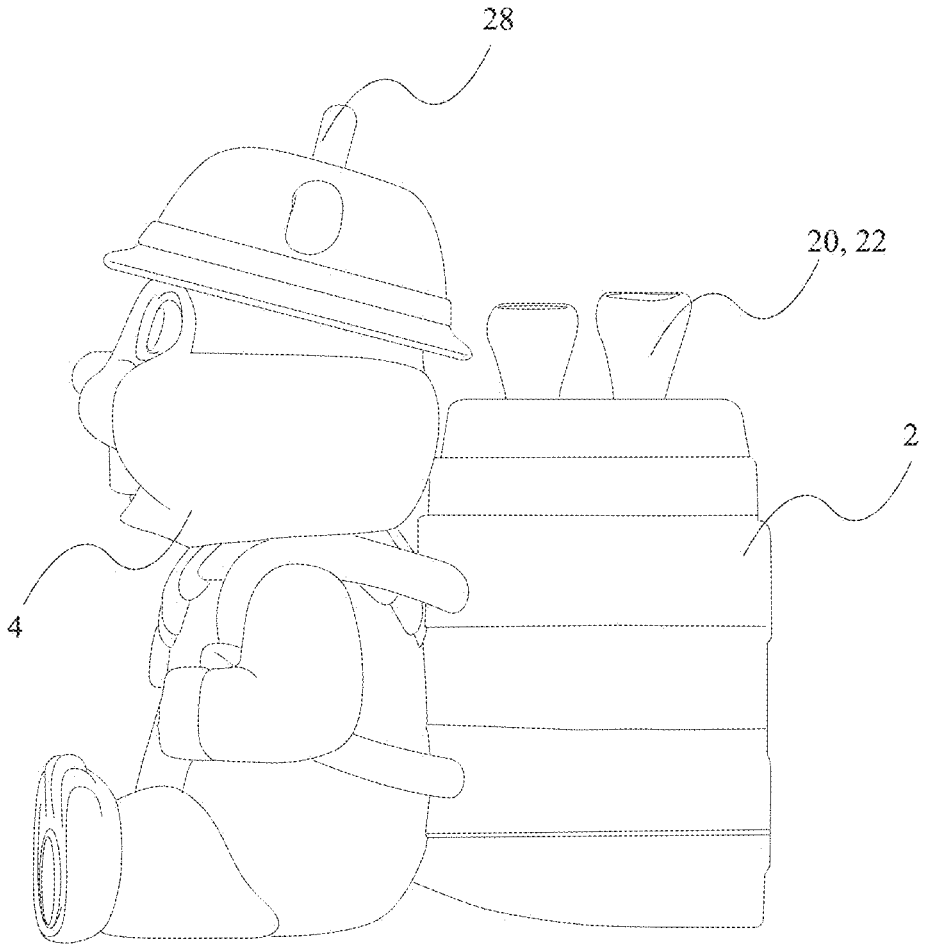
FIG. 11 is a side elevational view of the present invention, wherein the support figurine is in a caricaturized shape a gopher.
Figure 12:
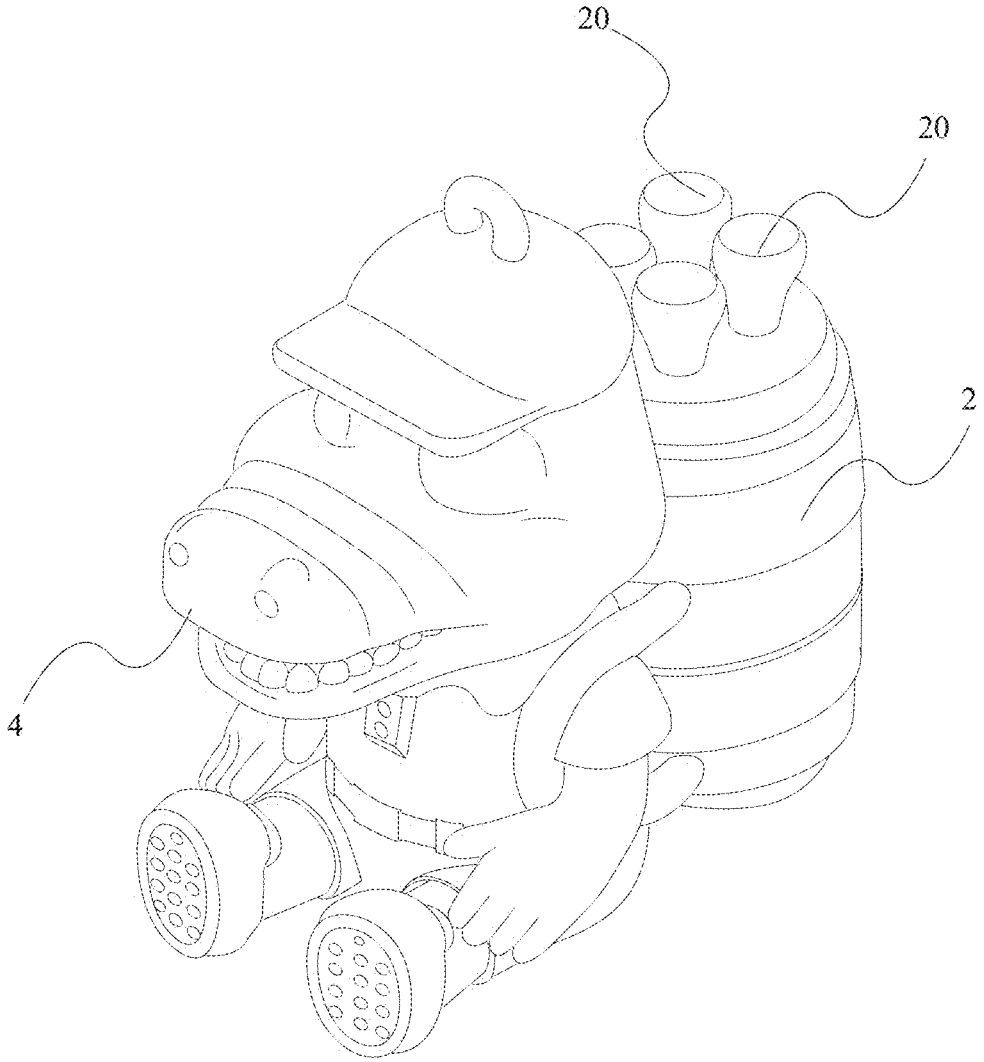
FIG. 12 is a top-front-left perspective view of the present invention, wherein the support figurine is in a caricaturized shape of a crocodile.
Figure 13:
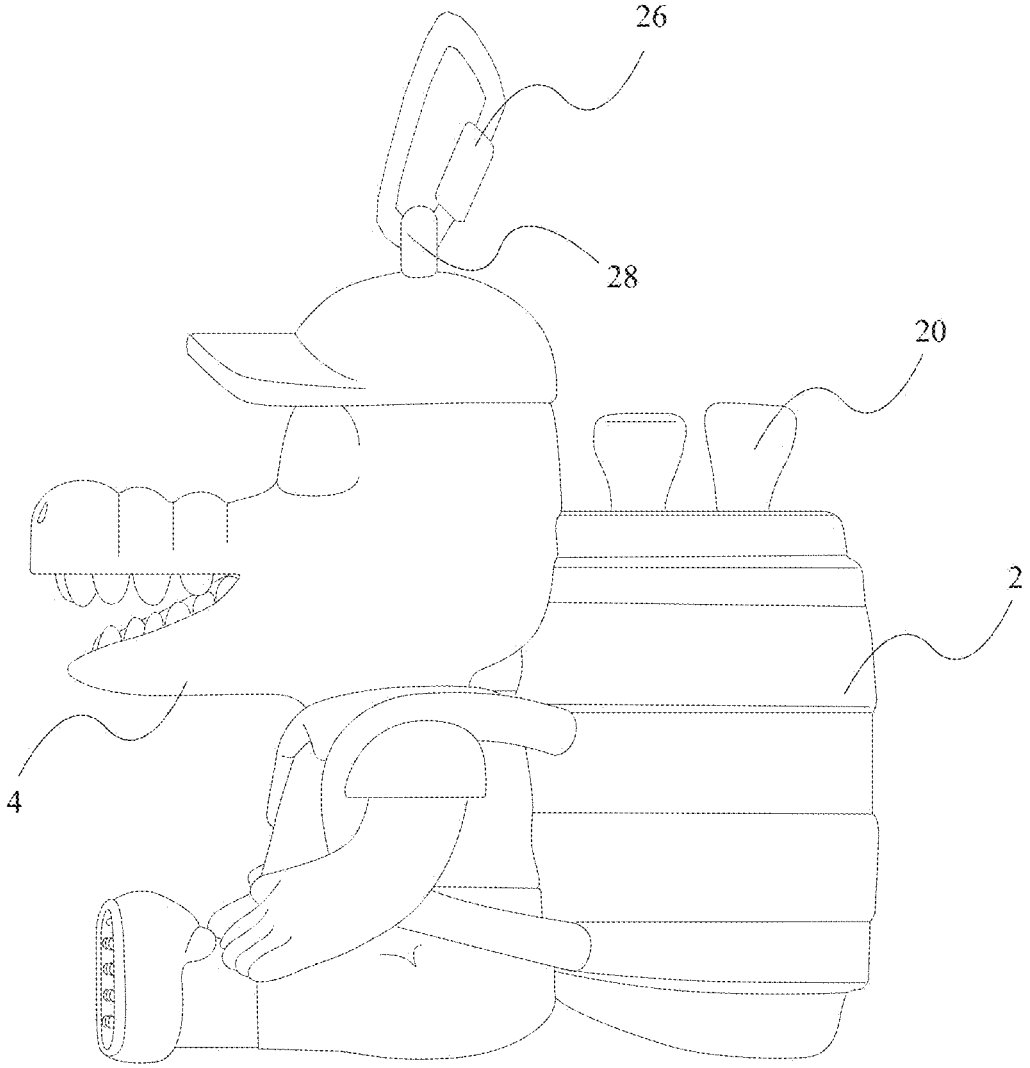
FIG. 13 is a side elevational view of the present invention, wherein the support figurine has the caricaturized shape a crocodile, and a fastener is connected to an eyelet mounted on the supportive figurine.
Figure 14:
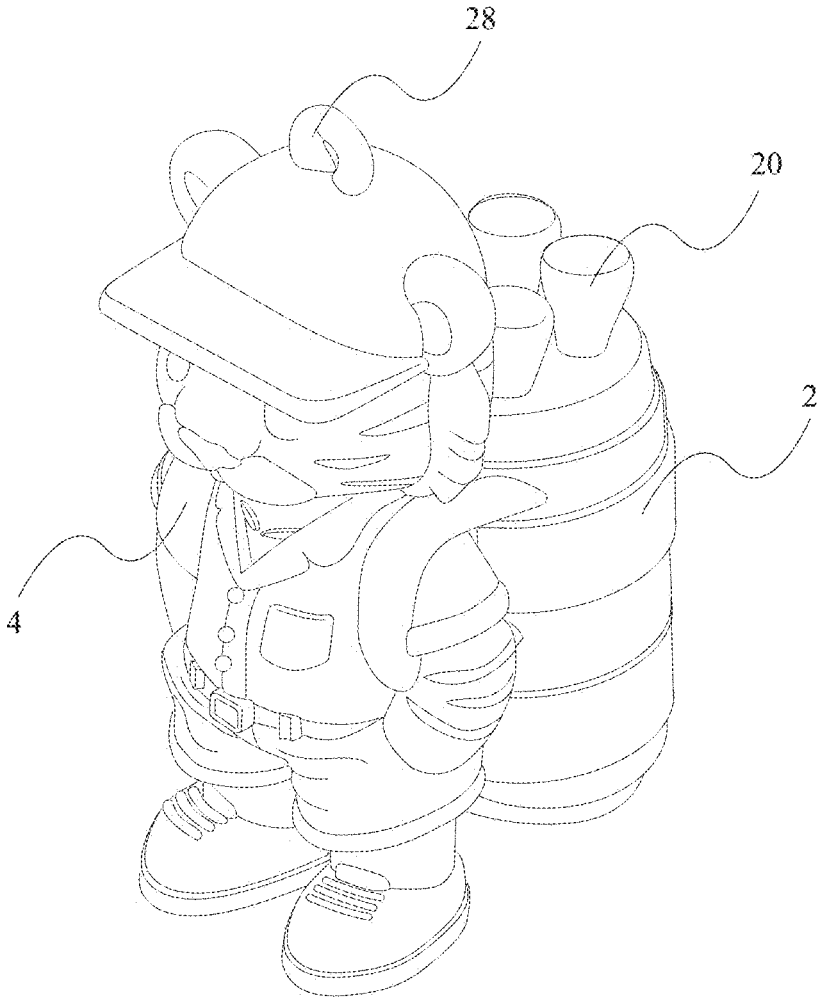
FIG. 14 is a top-front-left perspective view of the present invention, wherein the supportive figurine is in a caricaturized shape of a tiger.

According to the preferred embodiment, a height of the support figurine 4 between the first figurine end 16 and the second figurine end 18 is greater than a height of the golf-bag-shaped body 2 between the first body end 8 and the second body end 10. Further, as seen in FIG. 4, FIG. 11, and FIG. 13, the second figurine end 18 is positioned coplanar to the second body end. This helps provide balance to the entire device and keep the device upright. Furthermore, the first figurine end 16 is positioned offset from the first body end 8. This is so that, even after placing the plurality of golf tees 20 in the plurality of tee-receiving holes 6, the device stays upright and has aesthetic appeal.

Continuing with the preferred embodiment, the present invention may further comprise a fastener 26 and an eyelet 28. The fastener 26 may be any fastening device that can help the user to attach the device to a preferred surface or object, such as golf bags, golf carts, fences, etc. Examples of the fastener 26 include, but are not limited to, D-clip, snap hook, carabiner, hook and loop fasteners, strings, etc. To help attach the fastener 26 to the present invention, the eyelet 28 is connected adjacent to the first figurine end 16. The eyelet 28 is a small hole or extension with an aperture that helps the user to thread the fastener 26. Accordingly, the fastener 26 is coupled to the eyelet 28. Thus, the present invention is a user-friendly, fun, and aesthetically appealing golf-tee holding device.

Although the invention has been explained in relation to its preferred embodiment, it is to be understood that many other possible modifications and variations can be made without departing from the spirit and scope of the invention as hereinafter claimed.

What is claimed is:

1. A golf-tee holding device comprising:
a golf-bag-shaped body;
a support figurine;
a plurality of tee-receiving holes;
the support figurine comprising a first lateral surface, a second lateral surface, a first figurine end, and a second figurine end;
the golf-bag-shaped body comprising a first body end and a second body end;
the first lateral surface being positioned opposite to the second lateral surface about the support figurine;
the first figurine end being positioned opposite to the second figurine end about the support figurine;
the first lateral surface and the second lateral surface being positioned in between the first figurine end and the second figurine end
the first body end being positioned opposite to the second body end about the golf-bag-shaped body;
the golf-bag-shaped body being connected adjacent to the second lateral surface;
each of the plurality of tee-receiving holes traversing from the first body end into the golf-bag-shaped body;
the plurality of tee-receiving holes being distributed across the first body end; and
the plurality of tee-receiving holes being positioned parallel to each other.

2. The golf-tee holding device of claim 1, wherein the support figurine is a caricature animal.

3. The golf-tee holding device of claim 2, wherein the caricature animal is a patriotically-decorated bald eagle.

4. The golf-tee holding device of claim 1 comprising:
a plurality of golf tees; and each of the plurality of golf tees being positioned into a corresponding tee-receiving hole from the plurality of tee-receiving holes.

5. The golf-tee holding device of claim 4 comprising:

each of the plurality of golf tees comprising a golf-tee head and a golf-tee shaft;

the golf-tee shaft being positioned within the corresponding tee-receiving hole; and the golf-tee head being positioned external to the corresponding hole, adjacent to the first body end.

6. The golf-tee holding device of claim 4, wherein a combined center of gravity between the support figurine and the golf-bag-shaped body is configured to hold the plurality of golf tees in an upright orientation.

7. The golf-tee holding device of claim 1 comprising:

a height of the support figurine between the first figurine end and the second figurine end being greater than a height of the golf-bag-shaped body between the first body end and the second body end;

the second figurine end being positioned coplanar to the second body end; and the first figurine end being positioned offset from the first body end.

8. The golf-tee holding device of claim 1 comprising:

a fastener;

an eyelet;

the eyelet being connected adjacent to the first figurine end; and the fastener being coupled to the eyelet.

9. The golf-tee holding device of claim 1, wherein the golf-bag-shaped body is made of silicone.

10. The golf-tee holding device of claim 1, wherein the support figurine is made of silicone.

11. A golf-tee holding device comprising:

a golf-bag-shaped body;

a support figurine;

a plurality of tee-receiving holes;

the support figurine comprising a first lateral surface, a second lateral surface, a first figurine end, and a second figurine end;

the golf-bag-shaped body comprising a first body end and a second body end;

the first lateral surface being positioned opposite to the second lateral surface about the support figurine;

the first figurine end being positioned opposite to the second figurine end about the support figurine;

the first lateral surface and the second lateral surface being positioned in between the first figurine end and the second figurine end the first body end being positioned opposite to the second body end about the golf-bag-shaped body;

the golf-bag-shaped body being connected adjacent to the second lateral surface;

the second figurine end being positioned coplanar to the second body end; and the first figurine end being positioned offset from the first body end;

each of the plurality of tee-receiving holes traversing from the first body end into the golf-bag-shaped body;

the plurality of tee-receiving holes being distributed across the first body end; and the plurality of tee-receiving holes being positioned parallel to each other.

12. The golf-tee holding device of claim 11, wherein the support figurine is a caricature animal.

13. The golf-tee holding device of claim 12, wherein the caricature animal is a patriotically-decorated bald eagle.

14. The golf-tee holding device of claim 11 comprising:

a plurality of golf tees;

each of the plurality of golf tees being positioned into a corresponding tee-receiving hole from the plurality of tee-receiving holes.

15. The golf-tee holding device of claim 14 comprising:

each of the plurality of golf tees comprising a golf-tee head and a golf-tee shaft;

the golf-tee shaft being positioned within the corresponding tee-receiving hole; and the golf-tee head being positioned external to the corresponding hole, adjacent to the first body end.

16. The golf-tee holding device of claim 14, wherein a combined center of gravity between the support figurine and the golf-bag-shaped body is configured to hold the plurality of golf tees in an upright orientation.

17. The golf-tee holding device of claim 11 comprising:

a height of the support figurine between the first figurine end and the second figurine end being greater than a height of the golf-bag-shaped body between the first body end and the second body end.

18. The golf-tee holding device of claim 11 comprising:

a fastener;

an eyelet;

the eyelet being connected adjacent to the first figurine end; and the fastener being coupled to the eyelet.

19. The golf-tee holding device of claim 11, wherein the golf-bag-shaped body is made of silicone.

* * * * *